US007922825B2

(12) United States Patent
Hata

(10) Patent No.: US 7,922,825 B2
(45) Date of Patent: Apr. 12, 2011

(54) EXTRANEOUS MATTER REMOVING SYSTEM FOR TURBINE

(75) Inventor: Satoshi Hata, Hiroshima (JP)

(73) Assignee: Mitsubishi Heavy Industries Compressor Corporation, Tokyo (JP)

( * ) Notice: Subject to any disclaimer, the term of this patent is extended or adjusted under 35 U.S.C. 154(b) by 0 days.

(21) Appl. No.: 12/435,673

(22) Filed: May 5, 2009

(65) Prior Publication Data

US 2009/0217949 A1 Sep. 3, 2009

Related U.S. Application Data

(63) Continuation of application No. 10/633,182, filed on Aug. 1, 2003, now abandoned.

(30) Foreign Application Priority Data

Aug. 9, 2002 (JP) ..... 2002-232468

(51) Int. Cl.
*F01D 5/18* (2006.01)

(52) U.S. Cl. ..... 134/18; 416/230; 415/115

(58) Field of Classification Search ..... 134/18
See application file for complete search history.

(56) References Cited

U.S. PATENT DOCUMENTS 3,935,034 A * 1/1976 Hayes ..... 428/472.1
4,059,123 A 11/1977 Bartos et al.
4,384,452 A * 5/1983 Rice ..... 60/39.182
4,548,040 A 10/1985 Miller et al.
5,480,283 A 1/1996 Doi et al.
5,573,604 A 11/1996 Gerdes
5,944,483 A 8/1999 Beck et al.
6,180,170 B1 1/2001 Grossmann et al.
(Continued)

FOREIGN PATENT DOCUMENTS

DE 1 032 468 6/1958
(Continued)

OTHER PUBLICATIONS

Saito et al., "Development of Scale Deposit Inhibition Technology Using Turbine Water-Cooled Nozzle", *Geotherman Resources, Council TRANSACTIONS*, vol. 19, Oct. 1995, pp. 469-474.
(Continued)

*Primary Examiner* — Michael Barr
*Assistant Examiner* — Jason P Riggleman
(74) *Attorney, Agent, or Firm* — Alston & Bird LLP

(57) ABSTRACT

An object of the present invention is to effectively remove extraneous matter adhering to turbine blades without disassembling equipment. A turbine in accordance with the present invention is provided with a pressure gage for detecting the pressure in a steam chamber between a stator blade and a moving blade. In a casing on the upstream side of the stator blade in a duct, a nozzle connected to a high-pressure water generator via a valve is installed. Similarly, in the stator blade, an introduction pipe which is connected to the high-pressure water generator via a valve is provided. The introduction pipe is connected with a nozzle in which many injection ports capable of causing water to flow onto both surfaces of the profile of the stator blade are formed. When extraneous matter adheres to the turbine blades, a control unit detects a rise in pressure via the pressure gage, whereby the control unit opens the valves to remove extraneous matter by means of high-pressure water.

10 Claims, 5 Drawing Sheets

U.S. PATENT DOCUMENTS

| | | | |
|---|---|---|---|
| 6,394,108 | B1 | 5/2002 | Butler |
| 6,502,403 | B1 | 1/2003 | Tazaki et al. |
| 6,659,715 | B2 | 12/2003 | Kuesters et al. |

FOREIGN PATENT DOCUMENTS

| | | | |
|---|---|---|---|
| JP | 58-77103 | | 5/1983 |
| JP | 58077103 | * | 5/1983 |
| JP | 60-69214 | | 4/1985 |
| JP | 61-169627 A | | 7/1986 |
| JP | 61169627 A | * | 7/1986 |
| JP | 63186866 | * | 8/1988 |
| JP | 4173956 | * | 6/1992 |

OTHER PUBLICATIONS

European Search Report for corresponding European Patent Application No. 03 017470.0 dated Jul. 28, 2005.

* cited by examiner

EXTRANEOUS MATTER REMOVING SYSTEM FOR TURBINE

CROSS-REFERENCE TO RELATED APPLICATIONS

This application is a continuation of U.S. application Ser. No. 10/633,182, filed Aug. 1, 2003 now abandoned, which claims priority to Japanese Patent Application No. 2002-232468, filed Aug. 9, 2002, which are hereby incorporated herein in their entirety by reference.

BACKGROUND OF THE INVENTION

1. Field of the Invention

The present invention relates to an extraneous matter removing system for turbine blades, which can remove extraneous matter (fouling) adhering to the surface of turbine stator blades, moving blades, and other structural members belonging to a turbine while the turbine is operated.

2. Description of Related Art

A steam turbine is provided with a plurality of stator blades which are disposed in the circumferential direction of a rotor shaft and moving blades which are disposed on the downstream side of the stator blades and are installed rotatably to a rotor. When the turbine is operated continuously, extraneous matter such as silica-based or sodium-based chemical substances contained in steam reacts to heat or pressure in the turbine, adhering to the surfaces of stator blades, moving blades, and the like, and grows gradually. The component and property of extraneous matter is different between the low-pressure side and the high-pressure side (upstream side and downstream side) of the stator blades and moving blades provided in a plurality of stages. If extraneous matter adheres to the surface of a turbine blade, the shape of turbine blade is changed from its original shape, so that turbine performance is degraded with elapsed time.

Conventionally, water cleaning or mechanical cleaning has been performed to remove extraneous matter adhering to the turbine blades. For water cleaning, there is available a method in which the plant is shut down and the turbine is stopped periodically, and the turbine is cleaned by introducing pure water into the turbine while the turbine is rotated at a very low speed. Also, in the mechanical cleaning method, hard extraneous matter is removed compulsorily by shotblasting or blast honing using fine powder.

BRIEF SUMMARY OF THE INVENTION

However, in water cleaning, it is difficult to remove extraneous matter that is less prone to dissolve in water, and in mechanical cleaning, the surface of turbine blade may be damaged. Further, in both of the cleaning methods the plant must be shut down for a long period of time. Therefore, an enormous production loss occurs, and maintenance costs for disassembling the equipment and facilities for performing cleaning are needed.

The present invention has been made in view of the above situation, and accordingly an object thereof is to provide an extraneous matter removing system for a turbine, which can efficiently remove extraneous matter adhering to turbine stator blades, moving blades, and the like while the equipment is being operated without disassembling the equipment.

In a turbine in which turbine blades provided with a moving blade which rotates together with a rotor and a stator blade which is located on the upstream side of the moving blade and is held on the casing side are housed in a duct, and the moving blade is rotated by a fluid introduced into the duct, an extraneous matter removing system in accordance with the present invention includes a pressure gage for detecting the pressure in the duct; a first water injection nozzle which is disposed in the stator blade and is connected to a water supply source via a first valve; and a control unit for regulating the opening of the first valve according to the pressure detected by the pressure gage, so that extraneous matter adhering to the surface of turbine blade are removed by water injected from the first water injection nozzle.

The extraneous matter removing system can remove extraneous matter adhering to the surface of the stator blade by injecting water from the first water injection nozzle onto the surface of the stator blade, and can remove extraneous matter adhering to the back surface of the moving blade by injecting water from the first water injection nozzle to the back surface side of the moving blade. Also, the moving blade can be subjected to surface reforming to prevent the moving blade from being damaged by water injected from the first water injection nozzle.

Also, in a turbine in which turbine blades provided with a moving blade which rotates together with a rotor and a stator blade which is located on the upstream side of the moving blade and is held on the casing side are housed in a duct, and the moving blade is rotated by a fluid introduced into the duct, an extraneous matter removing system in accordance with the present invention includes a pressure gage for detecting the pressure in the duct; a second water injection nozzle which is disposed at a position on the upstream side of the position at which the stator blade is disposed and is connected to a water supply source via a second valve; and a control unit for regulating the opening of the second valve according to the pressure detected by the pressure gage, so that extraneous matter adhering to the surface of turbine blade are removed by water injected from the second water injection nozzle.

In the extraneous matter removing system, the stator blade can be subjected to surface reforming to prevent the stator blade from being damaged by the injected water.

DETAILED DESCRIPTION OF THE INVENTION

An extraneous matter removing system for a turbine in accordance with an embodiment of the present invention will now be described with reference to the accompanying drawings.

Figure 1:
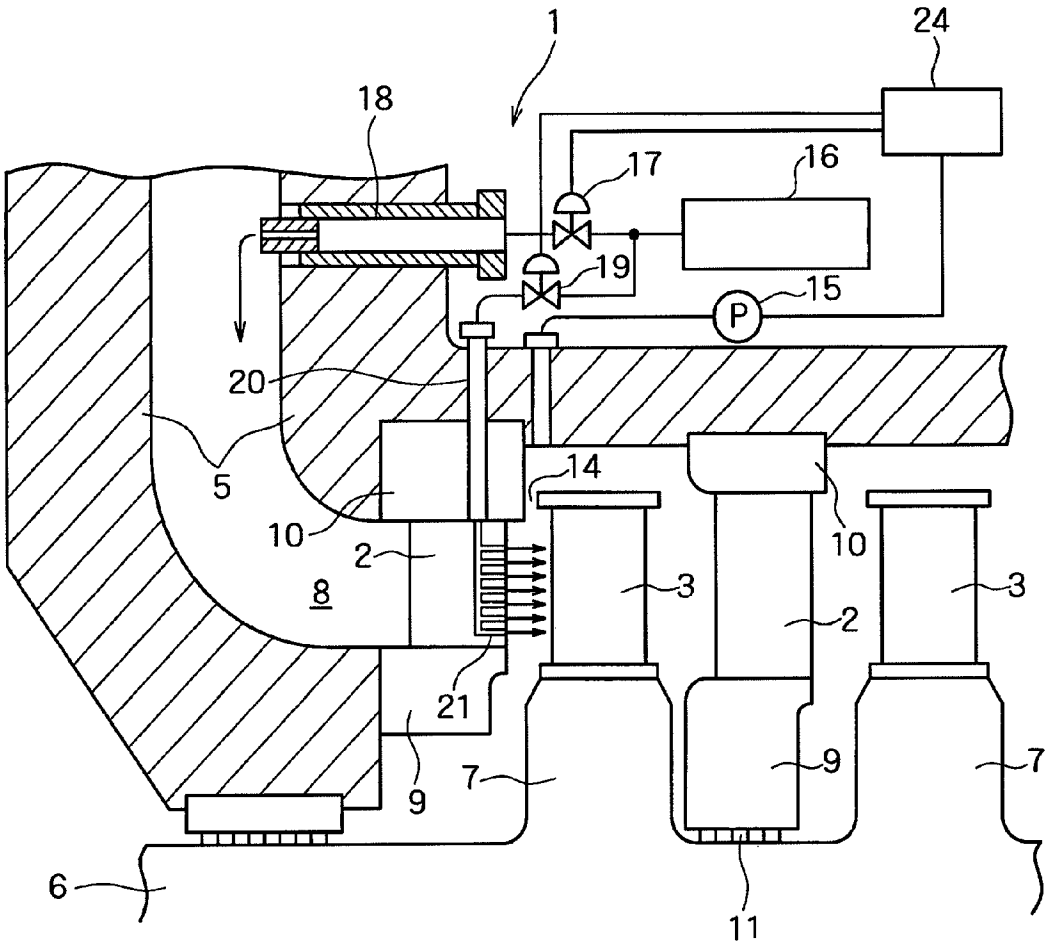
FIG. 1 is a schematic sectional view showing an essential portion of an extraneous matter removing system for a turbine in accordance with an embodiment of the present invention.
Figure 2:
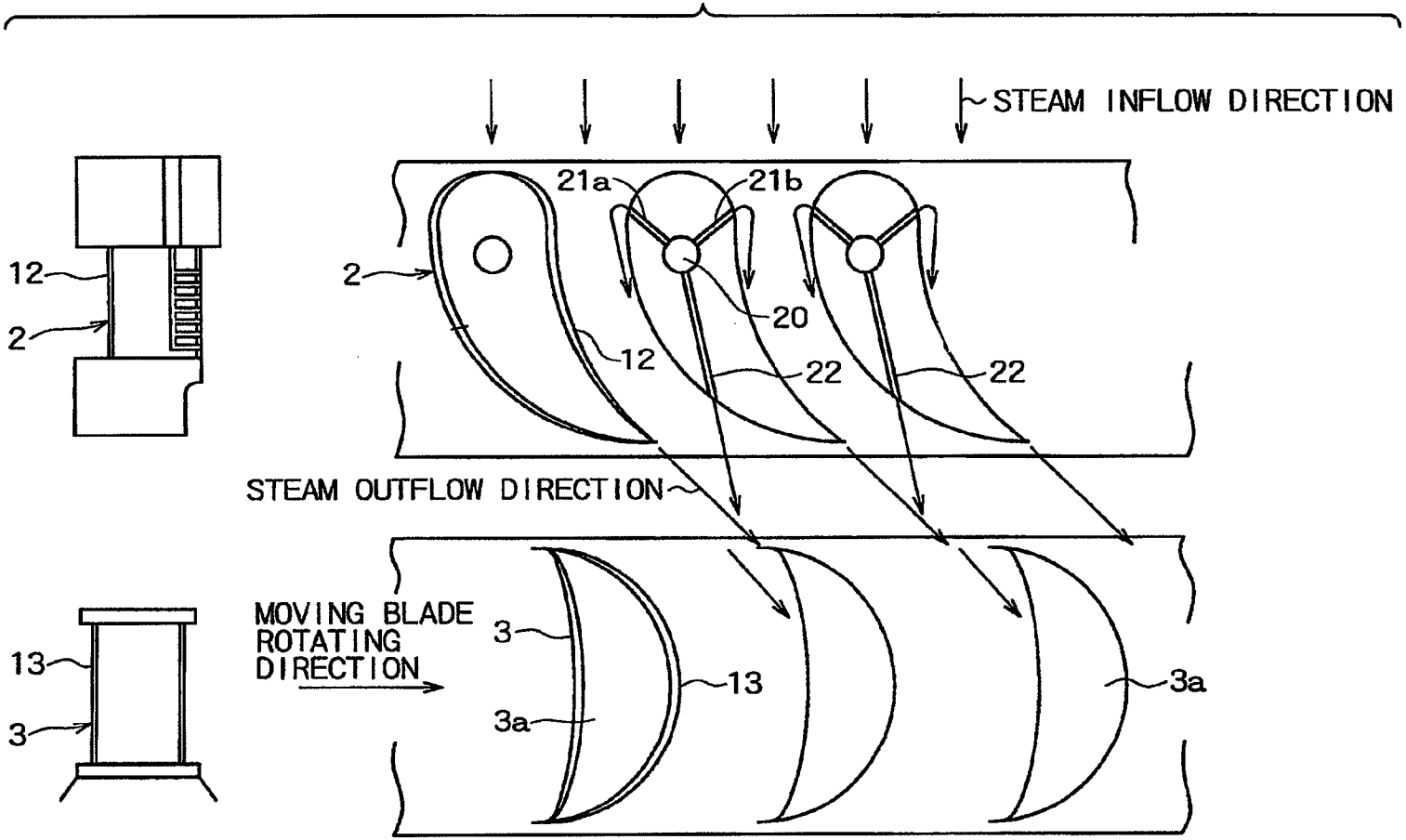
FIG. 2 is a sectional view of stator blades and moving blades of the turbine shown in FIG. 1.

FIG. 1 shows the high-pressure steam inlet side of a steam turbine 1 in accordance with the present invention. The upper part of FIG. 2 shows stator blades 2 of the turbine shown in FIG. 1, and the lower part thereof shows moving blades 3. In a casing 5 of the turbine 1, a rotor 6 rotatably supported on bearings (not shown) and a duct (flow passage) 8 are provided. The rotor 6 is provided with disks 7 projecting from the outer periphery of the rotor 6 to the outside (in the radial direction) and moving blades 3 supported on the disks 7. The moving blade 3 has many fins 3*a* as shown in FIG. 2.

The stator blade 2 is provided on the upstream side of the moving blade 3. On the inner periphery side and outer peripheral side of the stator blade 2, partition plates 9 and 10 are installed, respectively, and these partition plates 9 and 10 are held on the casing side. The stator blade 2 and the moving blade 3 are provided in a plurality of stages so as to be alternate in the axial direction of the rotor 6 with the stator blade 2 being located on the upstream side. The stator blade 2 is fixed on the casing side, and the moving blade 3 is installed to the rotor 6 so as to be rotatable together with the rotor 6. Also, between the inside partition plate 9 and the rotor 6, a seal 11 is mounted to keep sealing performance.

As shown in the upper part of FIG. 2, the peripheral surface of the stator blade 2 is subjected to surface reforming 12 by hardening diffusion heat treatment such as boronizing to prevent erosion. Although the surface reforming 12 is shown only in a part of the stator blade 2 for convenience, other parts and the stator blades 2 on the downstream side are also subjected to the surface reforming 12 in the same way.

Also, as shown in the lower part of FIG. 2, the peripheral surface of the moving blade 3 is subjected to surface reforming 13 by coating using a chemical evaporation film such as ion plating to prevent erosion. Although the surface reforming 13 is shown only in a part of the moving blade 3 for convenience, other parts and the moving blades 3 on the downstream side are also subjected to the surface reforming 13 in the same way.

The stator blade 2 may be subjected to surface reforming by coating, or the moving blade 3 may be subjected to surface treatment by hardening diffusion heat treatment.

As shown in FIG. 1, the turbine 1 is provided with a pressure gage 15 for detecting the pressure in a steam chamber 14 between the stator blade 2 and the moving blade 3. In the casing 5 on the upstream side of the stator blade 2 in the duct 8, there is provided a nozzle 18 which is connected to a high-pressure water (or saturated steam) generator 16 via a valve 17. Similarly, in the stator blade 2, an introduction pipe 20 that is connected to the high-pressure water generator 16 via a valve 19 is provided.

As shown in FIG. 2, the introduction pipe 20 is connected with an injection nozzle 21, for example, 21*a*, 21*b*, in which many injection ports capable of causing water to flow onto both surfaces of the profile of the stator blade 2 are formed in two directions. The injection ports of the nozzle 21*a*, 21*b* should be located on the upstream side of the stator blade 2 to the utmost.

The stator blade 2 is provided with many injection nozzles 22 to inject high-pressure water onto the back surface of the moving blade located on the downstream side thereof.

Figure 3:
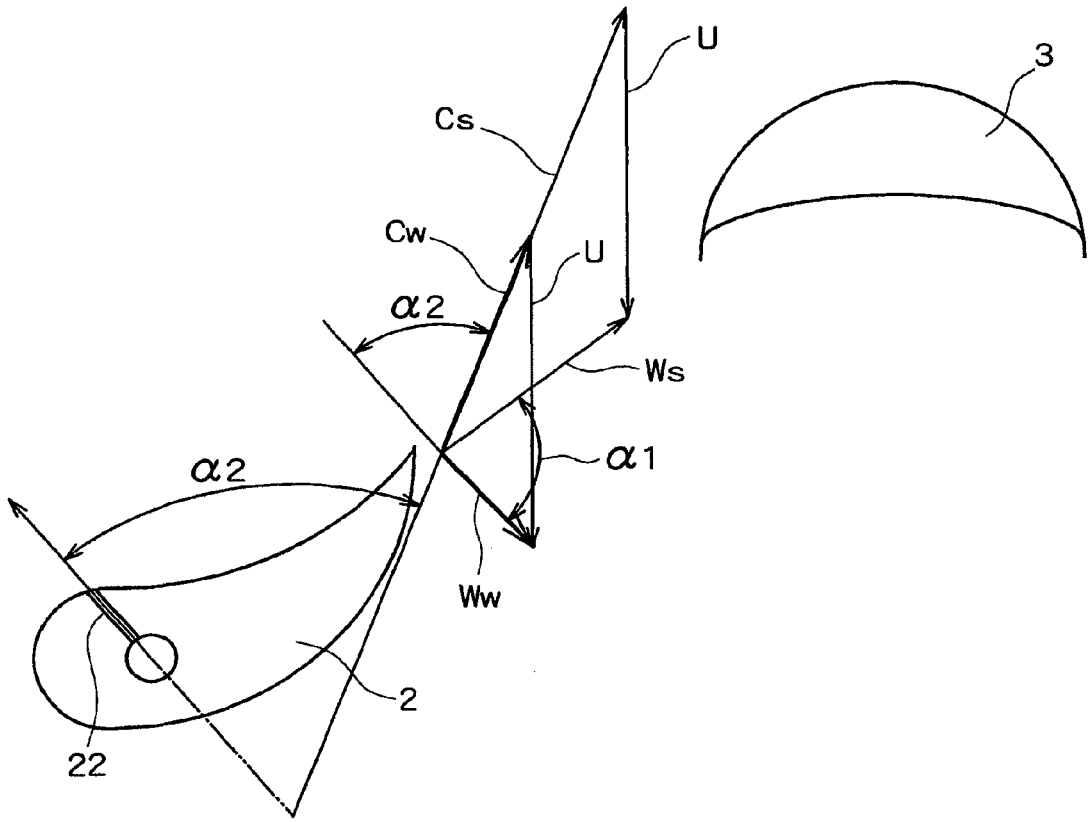
FIG. 3 is a schematic view for illustrating how the injection angle of a nozzle from which high-pressure water is injected is determined.

FIG. 3 is a schematic view for illustrating an example of a method for setting the injection angle of the nozzle 22.

In order to inject water particles of the nozzle 22 onto the back surface of the moving blade 3, the flow of water particles has only to be caused to coincide with high-pressure water steam flowing between the stator blades 2. However, the injection angle and the injection speed are different between them, and the moving blade is rotating, so that even if the direction of the nozzle 22 is made equal to the direction of the high-pressure water steam, there arises a difference in phase between them. Therefore, the injection angle of the nozzle 22 has only to be set so as to eliminate this difference in phase. The injection angle can be set as described below.

Reference character Cs in FIG. 3 denotes a nozzle outlet steam velocity and direction of the high-pressure water steam flowing between the stator blades 2 to rotate the moving blade 3. Cw denotes a water particle outlet velocity of the nozzle 22. The direction thereof is caused to coincide with that of the outlet steam velocity Cs. U denotes a rotation circumferential speed and a direction of the moving blade 3. These values of Cs, Cw and U can be measured by instruments or calculation. If the relative speed between the nozzle outlet steam velocity Cs and the moving blade rotation circumferential speed U is determined, a steam moving blade inlet relative speed Ws and its direction can be determined. Also, if the relative speed between the water particle outlet velocity Cw and the moving blade rotation circumferential speed U is determined, a water particle moving blade inlet relative speed Ww and its direction can be determined.

Since the moving blade 3 rotates and the values of Cs and Cw are different, there arises a phase difference of angle $\alpha 1$ in the clockwise direction between the steam moving blade inlet relative speed Ws and the water particle moving blade inlet relative speed Ww. Therefore, in order to inject water particles of the nozzle 22 onto the back surface of the moving blade 3 like the nozzle outlet steam velocity Cs, the injection direction of the nozzle 22 must be returned to the opposite side through angle $\alpha 1$ with respect to the direction of the nozzle outlet steam velocity Cs (water particle outlet velocity Cw) at which water particles are injected. Thus, an injection angle $\alpha 2$ of the nozzle 22 shifted through an angle equal to angle $\alpha 1$ in the counterclockwise direction with respect to the direction of the nozzle outlet steam velocity Cs is determined. Thus, by returning the injection direction of nozzle through $\alpha 2$ with respect to the direction of high-pressure water steam, water particles of the nozzle 22 can be injected onto the back surface of the moving blade.

As shown in FIG. 1, the pressure gage 15 and the valves 17 and 19 connect with a control unit 24, so that the control unit 24 can regulate the openings of the valves 17 and 19 according to the pressure value of the pressure gage 15. Although explanation is omitted, the stator blade 2 on the downstream side separately has nozzles 21*a*, 21*b* and 22 provided with the valves 17 and 19, and injected water is driven by the control unit 24.

Next, the operation of the extraneous matter removing system for a turbine in accordance with the embodiment of the present invention will be described.

Figure 4:
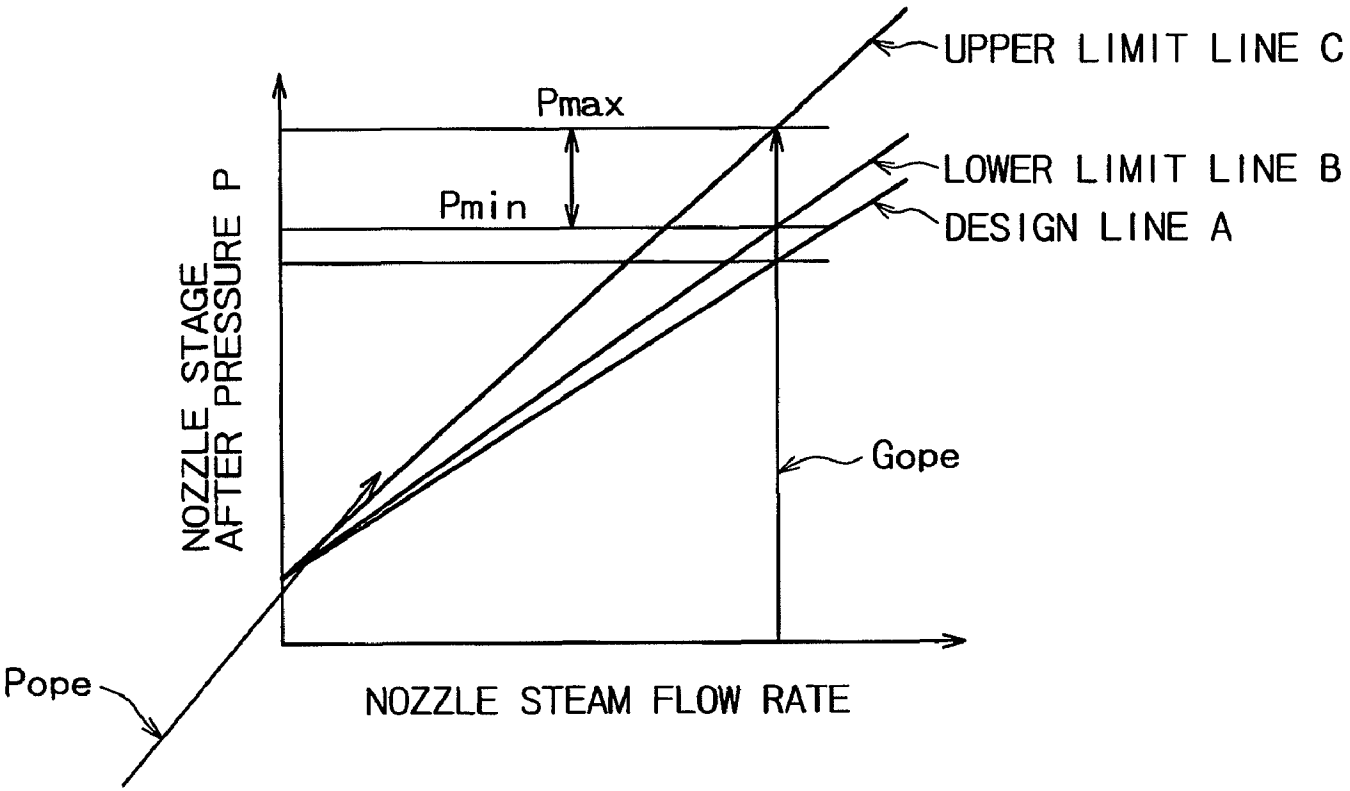
FIG. 4 is a diagram showing the relationship between nozzle stage after pressure and nozzle steam flow rate.
Figure 5:
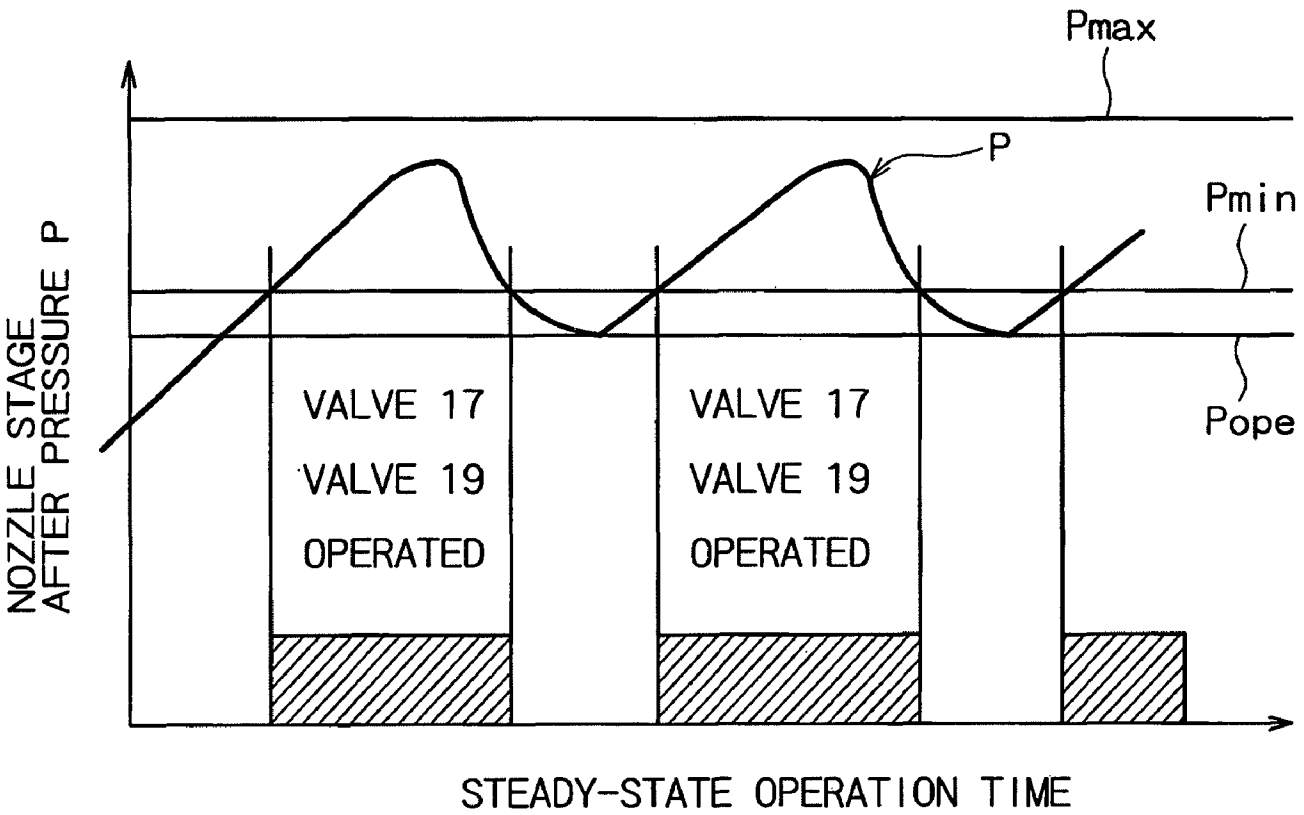
FIG. 5 is a diagram showing the relationship between nozzle stage after pressure and steady-state operation time.

FIGS. 4 and 5 are diagrams for illustrating the operating state of the turbine 1.

In FIG. 4, the vertical axis represents nozzle stage after pressure P, i.e., pressure at the after stage of the stator blade 2, and the horizontal axis represents nozzle steam flow rate, i.e., pressure in the steam chamber 14. An operation time pressure $P_{ope}$ is a pressure at the normal operation time, and $P_{max}$ and $P_{min}$ represent a vertical width of the range of cleaning implementation pressure for removing extraneous matter. $P_{max}$ is equal to a casing strength design allowable pressure $P_{d\ allw}$. As shown in FIG. 4, as the nozzle steam flow rate increases, the nozzle stage after pressure P increases. $G_{ope}$ denotes the maximum flow rate of steam. From the relationship between nozzle steam flow rate and nozzle stage after pressure P shown in FIG. 4, it is found that when the pressure exceeds design line A, extraneous matter adheres to the turbine blades 2 and 3. Specifically, since adhesion of extraneous matter decreases the steam passing area of nozzle, the closure ratio with respect to the design nozzle area is found by the steam flow rate value.

In FIG. 5, the vertical axis represents nozzle stage after pressure P and the horizontal axis represents operation time of the turbine 1. Also, horizontal lines $P_{ope}$, $P_{min}$, and $P_{max}$ are the same as those in FIG. 4.

High-pressure steam generated by a boiler (not shown) is introduced from the stator blade 2 to the moving blade side via the duct 8. The moving blade 3 converts the thermal energy of steam into mechanical rotation energy when steam passes through the moving blade 3. During the operation of the turbine 1, chemical substances etc. contained in the steam adhere to the turbine blades 2 and 3. On the low-pressure side of the turbine 1, extraneous matter that is relatively prone to dissolve in water adheres to the turbine blades 2 and 3, and on the high-pressure side, hard extraneous matter that is less prone to dissolve in water adheres to the turbine blades 2 and 3.

If extraneous matter adheres to the turbine blades 2 and 3, the steam passing area decreases, so that the pressure in the steam chamber 14, which is near $P_{ope}$ at a normal time, increases exceeding $P_{ope}$.

An example of a method for cleaning extraneous matter on the turbine blades 2 and 3 is as described below. In the case where the nozzle steam flow rate is the maximum flow rate $G_{ope}$ at the operation time, if the pressure in the steam chamber 14 exceeds $P_{min}$, the control unit 24 sends signals for opening the valves 17 and 19 based on the input from the pressure gage 15, by which high-pressure water from the high-pressure water generator 16 is injected through the nozzles 18, 21*a*, 21*b* and 22. The high-pressure water injected from the nozzle 18 located on the upstream side of the turbine blades 2 and 3 removes extraneous matter adhering to the nozzle of the stator blade 2 through which steam passes, and the nozzles 21*a* and 21*b* in the stator blade 2 clean the surface of the stator blade 2.

Also, the other nozzle 22 in the stator blade 2 injects high-pressure water onto the back surface of the moving blade 3. This high-pressure water can remove hard extraneous matter adhering to the surface of the moving blade 3 as if peeling them off. Since the surface of the moving blade 3 is subjected to the surface reforming 13 by ion plating, the surface of the moving blade 3 can be prevented from being damaged by high-pressure water.

If extraneous matter on the turbine blades 2 and 3 is removed, the flow of steam becomes smooth. If the pressure in the steam chamber decreases to a value below $P_{min}$, the control unit 24 detects this fact via the pressure gage 15, and closes the valves 17 and 19 to stop the supply of high-pressure water particles. Thus, the turbine 1 returns to a normal operation state. The normal operation of the turbine continues for a while, and if the pressure in the steam chamber 14 again exceeds $P_{min}$, the valves 17 and 19 are opened. Such operations are performed alternately each time $P_{min}$ is exceeded (see FIG. 5).

Thereupon, when the pressure takes a value between $P_{min}$ and $P_{max}$, the extraneous matter removing system is operated to remove extraneous matter adhering to the turbine blades 2 and 3. If the pressure in the steam chamber 14 exceeds $P_{max}$, the pressure of the turbine 1 should be decreased.

As described above, in this embodiment, extraneous matter on the turbine blades 2 and 3 is removed during the continued operation of the turbine 1, by which the turbine 1 is prevented from being deteriorated. Also, extraneous matter can be removed efficiently so as to match the designed fouling characteristics of steam turbine. The secondary damage to the turbine blades 2 and 3 caused by the use of high-pressure water in cleaning can be prevented because the turbine blades 2 and 3 are subjected to the surface reforming 12, 13. Since the turbine is not disassembled for cleaning, the running cost can be decreased due to increased efficiency of long-term continued operation, and the maintenance costs can be reduced.

The above is a description of one embodiment of the present invention. It is a matter of course that the present invention can be modified and changed variously based on the technical concept of the present invention.

For example, in the above-described embodiment, water particles are injected at the same time through all of the nozzles 18, 21*a*, 21*b* and 22. However, according to the state in the turbine at that time, water particles may be injected through some of the nozzles individually without the use of all of the nozzles.

According to the extraneous matter removing system for a turbine in accordance with the present invention, in a turbine in which turbine blades provided with a moving blade which rotates together with a rotor and a stator blade which is located on the upstream side of the moving blade and is held on the casing side are housed in a duct, and the moving blade is rotated by a fluid introduced into the duct, the extraneous matter removing system includes a pressure gage for detecting the pressure in the duct; a first water injection nozzle which is disposed in the stator blade and is connected to a water supply source via a first valve; and a control unit for regulating the opening of the first valve according to the pressure detected by the pressure gage, so that extraneous matter adhering to the surface of turbine blade is removed by water injected from the first water injection nozzle. Therefore, extraneous matter adhering to the turbine blades can be removed without disassembling the turbine or shutting down the turbine (plant).

Also, extraneous matter adhering to the surface of the stator blade can be removed efficiently by injecting water from the first water injection nozzle onto the surface of the stator blade.

Further, extraneous matter adhering to the back surface of the moving blade can be removed by injecting water from the first water injection nozzle to the back surface side of the moving blade.

Since the surface of the moving blade is subjected to surface reforming to prevent the moving blade from being damaged by water, the moving blade can be prevented from being damaged even if high-pressure water is injected onto the moving blade.

The invention claimed is:

1. A method of removing extraneous matter from the blades of a steam turbine having a casing defining a duct, and turbine blades housed in the duct, the turbine blades including a moving blade which rotates together with a rotor and a stator blade which is located on the upstream side of the moving blade and is held on the casing side, wherein the stator blade comprises opposing surfaces, the duct is operatively positioned to introduce a fluid to the turbine blades, and the moving blade is rotated by said fluid introduced into the duct, comprising:

disposing a first water injection nozzle at a position upstream of the stator blade and connected to a water supply source via a first valve, the first water injection nozzle operatively positioned to inject water onto the stator blade;

disposing a plurality of water injection nozzles in the stator blade and connected to a water supply source via a second valve, wherein the plurality of water injection nozzles comprises a first plurality of nozzles operatively positioned to cause water to flow onto both opposing surfaces of the stator blade and a second plurality of nozzles operatively positioned to inject water directly onto a back surface of the moving blade located downstream;

detecting the pressure between the stator blade and the moving blade while steam flows through the duct and past the turbine blades; and regulating the opening of said first and second valves according to the pressure detected between the stator blade and the moving blade so that, when the detected pressure has a value exceeding a predetermined minimum pressure, one or both of the valves are opened while steam flows through the duct in order to remove extraneous matter adhering to the surface of the turbine blades;

wherein the angle of the second plurality of water injection nozzles is set such that a difference in phase between the steam flow toward the moving blade and the water injected from the second plurality of water injection nozzles is eliminated.

2. The method according to claim 1, wherein only one of the valves is opened when the detected pressure has a value exceeding the predetermined minimum pressure.

3. The method according to claim 1, wherein the first valve is opened when the detected pressure has a value exceeding the predetermined minimum pressure such that water from the first water injection nozzle is injected into the steam flow and contacts the stator blade located downstream from the first water injection nozzle.

4. The method according to claim 1, wherein the second valve is opened when the detected pressure has a value exceeding the predetermined minimum such that water flows onto both opposing surfaces of the stator blade and water is injected into the steam flow and directly onto a back surface of the moving blade located downstream.

5. The method according to claim 1, wherein at least one of the moving blade and the stator blade has undergone a surface reforming treatment adapted to prevent damage caused by water injection.

6. The method according to claim 5, wherein the surface reforming treatment comprises a hardening diffusion heat treatment or a chemical evaporation film coating.

7. The method according to claim 5, wherein the stator blade has undergone a surface reforming treatment comprising a boronizing treatment.

8. The method according to claim 5, wherein the moving blade has undergone a surface reforming treatment comprising an ion plating treatment.

9. The method according to claim 1, wherein the first plurality of water injection nozzles in the stator blade are oriented towards the upstream side of stator blade.

10. The method according to claim 1, wherein the difference in phase is determined based on the calculated relative speed, Ww, between the water injection nozzle outlet velocity and the moving blade rotation circumferential speed, the direction of Ww, the calculated relative speed, Ws, between the steam flow outlet velocity and the moving blade rotation circumferential speed, and the direction of Ws.

* * * * *